US005763802A

United States Patent [19]

Aoki et al.

[11] Patent Number: 5,763,802

[45] Date of Patent: Jun. 9, 1998

[54] APPARATUS FOR CHORD ANALYSIS BASED ON HARMONIC TONE INFORMATION DERIVED FROM SOUND PATTERN AND TONE PITCH RELATIONSHIPS

[75] Inventors: Eiichiro Aoki; Kazunori Maruyama, both of Hamamatsu, Japan

[73] Assignee: Yamaha Corporation, Japan

[21] Appl. No.: 719,328

[22] Filed: Sep. 25, 1996

[30] Foreign Application Priority Data

Sep. 27, 1995 [JP] Japan ..... 7-273519

[51] Int. Cl.[6] ..... G10H 1/38

[52] U.S. Cl. ..... 84/613; 84/637; 84/DIG. 22

[58] Field of Search ..... 84/613, 637, 650–652, 84/669, DIG. 22

[56] References Cited

U.S. PATENT DOCUMENTS

| | | | |
|---|---|---|---|
| 4,144,788 | 3/1979 | Bione et al. | 84/613 X |
| 4,466,326 | 8/1984 | Ogura et al. | 84/637 |
| 4,951,544 | 8/1990 | Minamitaka | 84/613 |
| 5,216,188 | 6/1993 | Shibukawa | 84/637 |
| 5,250,746 | 10/1993 | Saito et al. | 84/613 |
| 5,418,325 | 5/1995 | Aoki et al. | 84/613 |
| 5,539,146 | 7/1996 | Tohgi | 84/650 |
| 5,563,361 | 10/1996 | Kondo et al. | 84/637 |

*Primary Examiner*—Stanley J. Witkowski
*Attorney, Agent, or Firm*—Rossi & Associates

[57] ABSTRACT

A chord analysis apparatus which includes a table memory for memorizing a plurality of sound timing patterns in a performance section of a predetermined number of beats, a plurality of tone pitch difference patterns corresponding with the sound timing patterns and a plurality of harmonic tone information data corresponding with the tone pitch difference patterns. In the tone pitch difference patterns, each difference in tone pitch between adjacent tones is represented by the number of semitones. After a performance information data of a desired musical tune has been divided each at two times, a pattern corresponding with the sound timing and tone pitch difference patterns in each divided section is searched at the table memory to read out a harmonic tone information data corresponding with the searched pattern thereby to detect each chord of the divided sections based thereon.

20 Claims, 9 Drawing Sheets

*Fig.2*

| | SOUND TIMING PATTERNS | TONE PITCH DIFFERENCE PATTERNS | HARMONIC TONES |
|---|---|---|---|
| T1 | | P1 | NONE |
| T2 | | P2 | FIRST TONE |
| T3 | $D_1$ $D_2$ $D_3$ | P3 { $D_1 = \pm 1, \pm 2$; $D_2 = \pm 1, \pm 2$; $D_3 = \pm 1, \pm 2$ } | FIRST AND SECOND TONES |
| T4 | $D_1$ $D_2$ $D_3$ | P4 { $D_1 = \pm 1, \pm 2$; $D_2 = \pm 1, \pm 2$; $D_3 = +3$ } | FIRST, THIRD AND FOURTH TONES |
| ⋮ | | ⋮ | ⋮ |
| Tm | D | Pm (D = 0) | FIRST AND SECOND TONES |
| Tm+1 | D | Pn (D = ±1, ±2) | FIRST TONE |
| ⋮ | | ⋮ | ⋮ |

*Fig. 6*

| | SOUND PATTERN | HARMONIC TONE |
|---|---|---|
| S1 | | NONE |
| S2 | | FIRST TONE |
| S3 | $Q_1$, $Q_2$, $Q_3$ [$Q_1 \sim Q_3 = 0$] | FIRST TO FOURTH TONES |
| S4 | $Q_1$, $Q_2$, $Q_3$ [$Q_1 = 2$, $Q_2 = 4$, $Q_3 = 5$] | FIRST AND THIRD TONES |
| ⋮ | ⋮ | ⋮ |

APPARATUS FOR CHORD ANALYSIS BASED ON HARMONIC TONE INFORMATION DERIVED FROM SOUND PATTERN AND TONE PITCH RELATIONSHIPS

BACKGROUND OF THE INVENTION

1. Field of the Invention

The present invention relates to a chord analysis apparatus suitable for use in automatic performance, and more particularly to a chord analysis apparatus in which harmonic tones (chord constituent tones) are detected on a basis of a sound timing and a tone pitch relationship to determine a chord in accordance with progression of a musical tune or melody.

2. Description of the Prior Art

As one of conventional chord analysis apparatuses of this kind, there has been proposed a chord analysis apparatus wherein harmonic tones are detected on a basis of a difference in tone pitch between adjacent tones in a melody performance information to determine a chord for accompaniment based thereon. Assuming that the conventional chord analysis apparatus has been applied with a melody performance information data starting from a strong beat as shown in FIG. 9(A), harmonic tones are detected as shown by arrows in FIG. 9(B) to determine chords in the form of "C", "$D_m$", "$A_m$", "G7", . . . shown in FIG. 9(B). When applied with the same melody performance information data in musical notes starting from a weak beat as shown in FIG. 9(C), chords in the form of "C", "$D_m$", "$E_m$", "G7", . . . are usually determined on a basis of harmonic tones detected as shown by arrows in FIG. 9(C). In the conventional apparatus, however, the harmonic tones are detected on a basis of only a difference in tone pitch between adjacent tones. For this reason, it is impossible to determine the chords in the melody performance information of FIG. 9(C) as in the melody performance information of FIG. 9(B).

SUMMARY OF THE INVENTION

It is, therefore, a primary object of the present invention to provide a chord analysis apparatus capable of determining a chord in accordance with progression of a musical tune or melody.

According to the present invention, the object is accomplished by providing a chord analysis apparatus which comprises memory means for memorizing a plurality of pattern information data each indicative of a sound timing and a tone pitch relationship in each performance section of a predetermined number of beats and memorizing a harmonic tone information data in the respective pattern information data, search means for searching a pattern information data corresponding with the sound timing and the tone pitch relationship in performance information of a musical tune, and means for reading out a harmonic tone information data corresponding the searched pattern information data from the memory means.

According to an aspect of the present invention, there is provided a chord analysis apparatus which comprises memory means for memorizing a plurality of pattern information data each indicative of a sound timing and a tone pitch relationship in each performance section of a predetermined number of beats, means for dividing performance information of a musical tune into each section of the predetermined number of beats, search means for searching a pattern information data corresponding with the sound timing and the tone pitch relationship in each divided section, read-out means for reading out a harmonic tone information data corresponding with the searched pattern information data at each divided section from the memory means, and chord determination means for determining each chord of the divided sections on a basis of the harmonic tone information data read out by the read-out means.

BRIEF DESCRIPTION OF THE DRAWINGS

Additional objects, features and advantages of the present invention will be more readily appreciated from the following detailed description of preferred embodiments thereof when taken together with the accompanying drawings, in which:

FIG. 2 illustrates a harmonic tone table stored in a table memory shown in FIG. 1;

FIG. 6 illustrates a modification of the harmonic tone table stored in the table memory;

DESCRIPTION OF THE PREFERRED EMBODIMENTS

Figure 1:
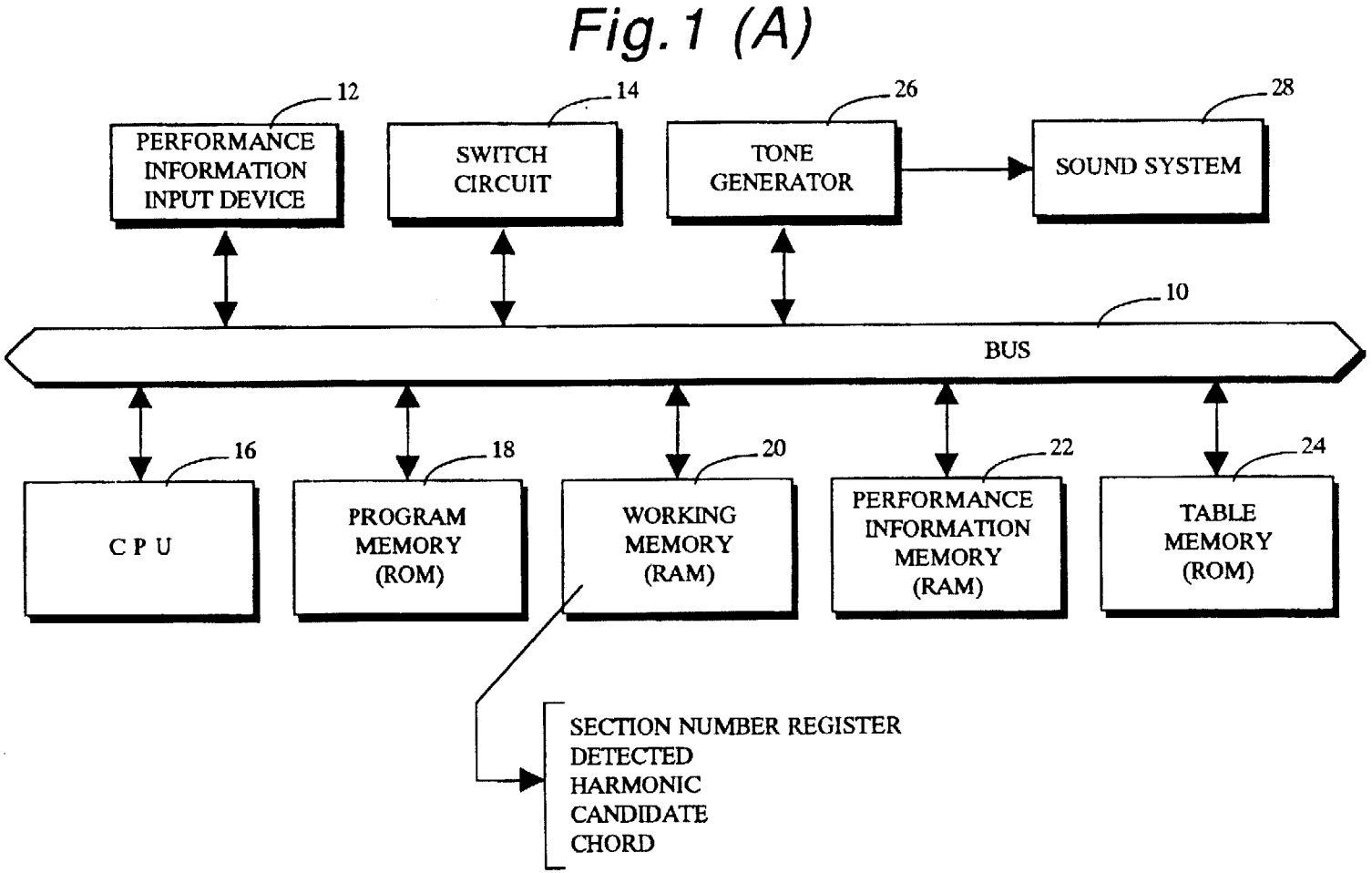
FIG. 1(A) is a block diagram of an automatic performance apparatus provided with a chord analysis apparatus in accordance with the present invention.
FIG. 1(B) is a block diagram of a modification of the automatic performance apparatus.
Figure 1:
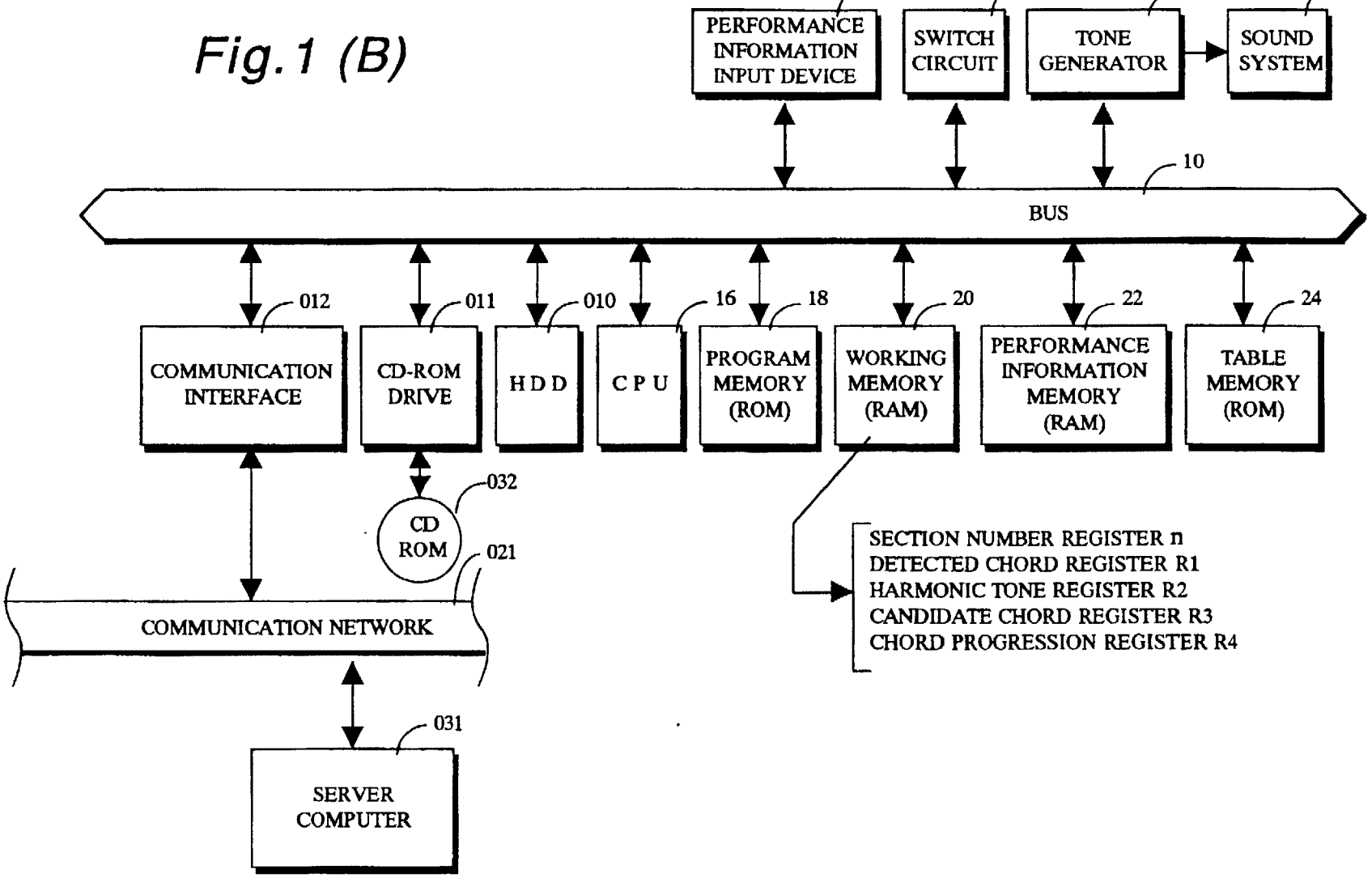

Illustrated in FIG. 1 of the drawings is an automatic performance apparatus wherein chord analysis and automatic performance are effected under control of a microcomputer. The microcomputer includes a data bus 10 connected to a performance information input device 12 and a switch circuit 14 and includes a central processing unit or CPU 16, a program memory 18, a working memory 20, a performance information memory 22 and a table memory 24 connected to the data bus 10. The data bus 10 is further connected to a sound system 28 through a tone generator 26.

The performance information input device 12 is in the form of a keyboard which is operated by a user to produce performance information of a desired musical tune or melody. The switch circuit 14 includes various kinds of switches for input of information and control of the performance and includes switches for inputting a key, a time, a measure line, etc. The CPU 16 is programmed to execute programs for chord analysis and automatic performance stored in the program memory 18 in the form of a read-only memory. The working memory 20 is in the form of a random access memory or RAM which includes memory regions used as registers for processing of the programs executed by the CPU 16. In this embodiment, the registers are in the form of a section number register n, a detected chord register R1, a harmonic tone register R2, a candidate chord register R3 and a chord progression register R4.

The performance information memory 22 is in the form of a random access memory or RAM to memorize performance information of a musical tune applied from the input device 12. The performance information memory 22 may be adapted to memorize performance information read out from a floppy disk or other external devices. The table memory 24 is in the form of a read-only memory or ROM to store a chord table and a harmonic tone table. The chord table is designed to memorize a number of chord names such as C Major and to memorize each tone name of chord constituent tones such as "C", "E2", "G", etc. in C Major. The harmonic tone table is designed as will be described in detail with reference to FIG. 2. The tone generator 26 is designed to generate a melody tone signal based on performance information read out from the performance information memory 22 during selection of an automatic performance mode and to generate a chord signal based on chord name information read out from the chord progression register R4 in the performance information memory 22. The sound system 28 is designed to convert a musical tone signal such as the melody tone signal, the chord signal or the like into a sound signal. During selection of the automatic performance mode, the sound system 28 generates an automatic melody tone and generates a chord as an automatic accompaniment tone.

Illustrated in FIG. 1(B) is a modification of the automatic performance apparatus wherein a hard disc drive or HDD 010, a compact disc read-only memory drive or CD-ROM drive 011 and a communication interface 012 are connected to the data bus 10 to cooperate with the CPU 16, working memory 20 and performance information memory 22. The HDD 011 includes a hard disc storing the programs for chord analysis and automatic performance and data required for execution of the programs as in the program memory 20. In operation, the CPU 16 causes the HDD 010 to memorize the programs and the data in the working memory 20 or performance information memory 22 and executes the program using the data. The CD-ROM drive 011 is adapted to read out the programs for chord analysis and automatic performance and data require for execution of the programs memorized in a CD-ROM and to store the programs and data in the hard disc of the HDD 010. In actual practices of the invention, the CD-ROM drive 011 may be replaced with an external memory device such a floppy disc device, a photomagnetic disc or the like.

The communication interface 012 is connected to a server computer 031 through a communication network such as a local area network or LAN, an internet, a telephone line or the like to down load the programs and data from the server computer 031. In operation, the automatic performance apparatus of the invention applies a command signal for requirement of down-load of the programs and data to the server computer 031 through the communication network 021. When received the command signal, the server computer 031 supplies the programs and data to the automatic performance apparatus through the communication network 021 to accumulate the programs and data in the working memory 20 or performance information memory 22.

Illustrated in FIG. 2 is an example of a harmonic tone table stored in the table memory 24. In the harmonic tone table, there are listed sound timing patterns T1, T2, T3, . . . $T_m$, $T_{m+1}$ for each performance section of two times, tone pitch difference patterns P1, P2, P3, . . . $P_m$, $P_{m+1}$ corresponding with the sound timing patterns, and harmonic tone information corresponding with the tone pitch difference patterns. The sound timing patterns are memorized in the table memory 24 in the form of an information data T1 of a half rest, an information data T2 of a half note, information data T3, T4 of four eighth notes, information data $T_m$, $T_{m+1}$ of two eighth notes and a quarter rest, etc. The tone pitch difference patterns are memorized in the table memory 24 in the form of mark information data P1, P2 respectively corresponding with the information data T1, T2 and tone pitch difference information data P3, P4, $P_m$, $P_{m+1}$ respectively corresponding with the information data T3, T4, $T_m$, $T_{m+1}$, etc. In the tone pitch difference information data, a difference in tone pitch between adjacent tones is represented by the number of semitones, a lower seminote is represented by a minus sign, and a higher seminote is represented by a plus sign. In the tone pitch difference information data P3, a difference D1 in tone pitch between first and second tones, a difference D2 in tone pitch between the second and third tones and a difference D3 in tone pitch between the third and fourth tones are represented by ±1 or ±2. In the tone pitch difference information P4, the differences D1, D2 in tone pitch are represented by ±1 or ±2, and the difference D3 in tone pitch is represented by more than +3 or less than −3. A tone pitch difference D in the tone pitch difference information data $P_m$ is represented by 0, and a tone pitch difference in the tone pitch difference information data $P_{m+1}$ is represented by ±1 or ±2.

The harmonic tone information corresponding with the tone pitch difference information data P1 is represented by a null since the information data T1 is a rest. The harmonic tone information corresponding with the information data P2 represents the name of a first tone corresponding with the half note of the information data T2. The harmonic tone information corresponding with the information data P3 represents the names of the first and third tones in the information data T3. The harmonic tone information corresponding with the information data P4 represents the names of the first, third and fourth tones in the information data T4. The harmonic tone information corresponding with the information data $P_m$ represents the names of the first and second tones in the information data $T_m$. The harmonic tone information corresponding with the information data $P_{m+1}$ represents the name of the first tone in the information data $T_{m+1}$.

Figure 3:
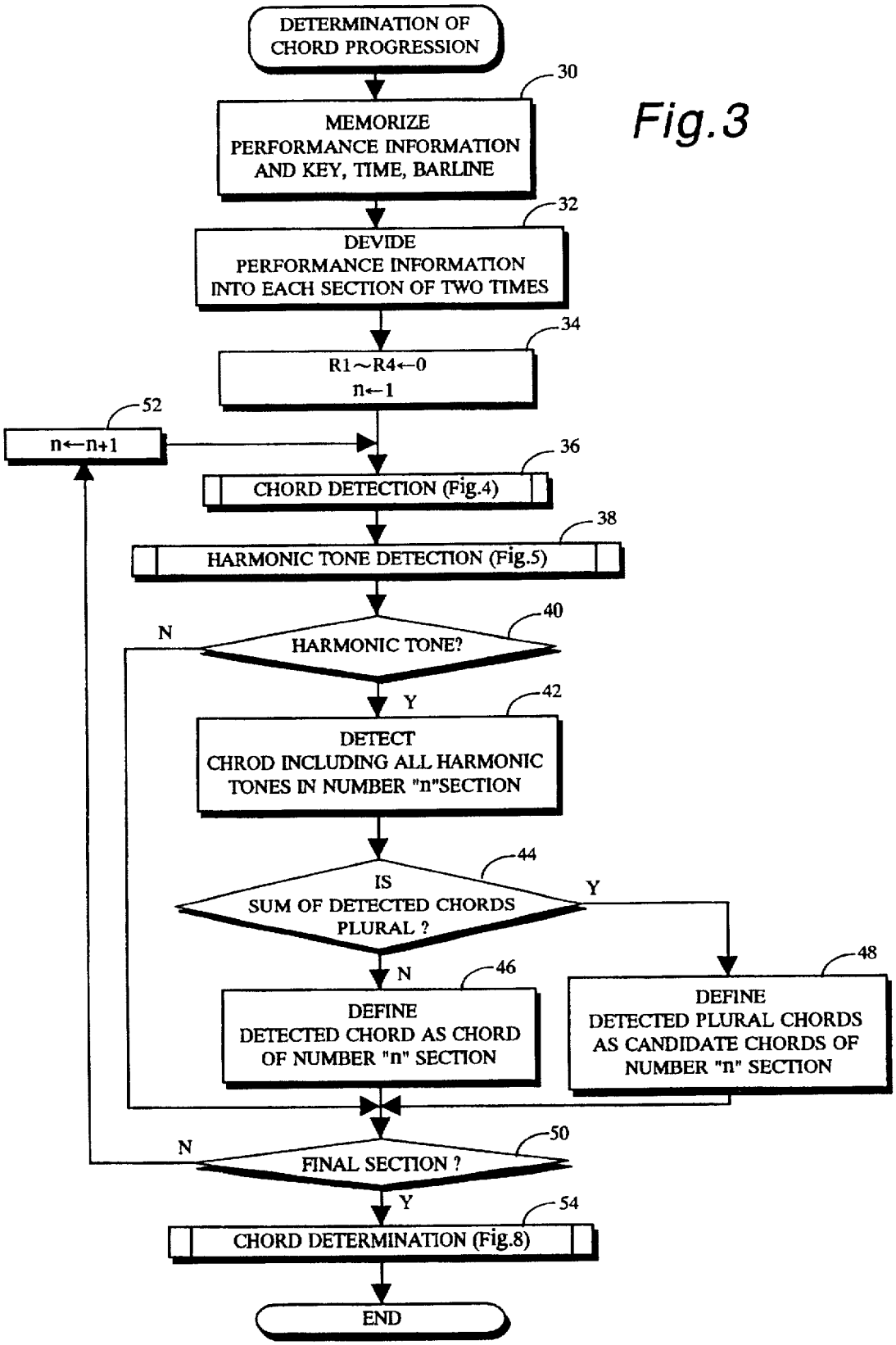
FIG. 3 is a flow chart of a program for determination of chord progression.
Figure 9:
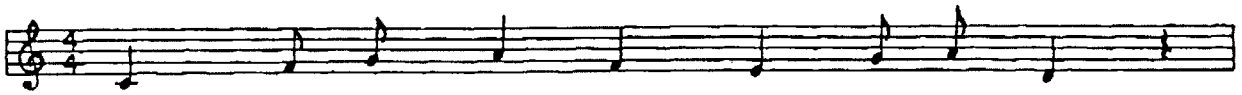
FIGS. 9(A)–9(C) illustrate musical notes for explaining detection of harmonic tones and determination of chords therein.
Figure 9:
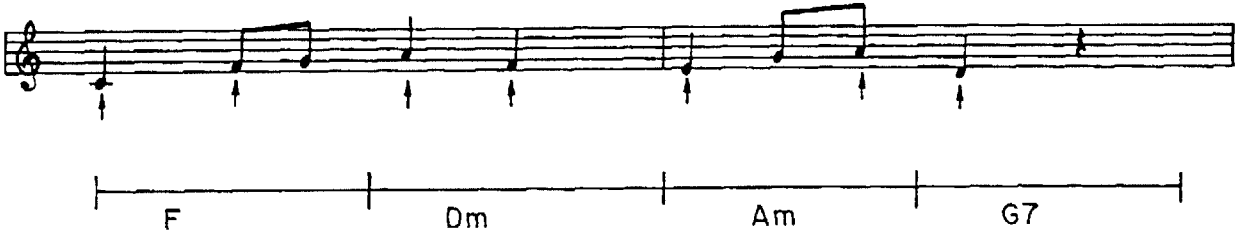
Figure 9:
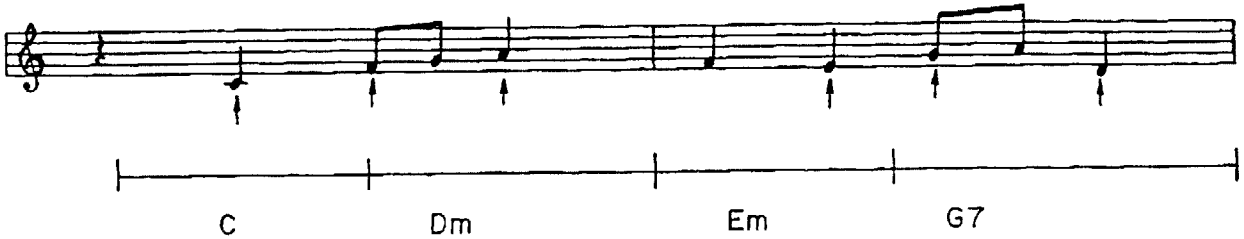

Illustrated in FIG. 3 is a program for determination of chord progression. When selected a chord analysis mode, the CPU 16 starts to execute the program for determination of the chord progression. At step 30, the CPU 16 reads out performance information data of a desired musical tune applied by the input device 12 and a key, a time and a bar line applied by the switches of switch circuit 14 and memorizes the performance information data, key, time and bar line in the performance memory 22. For instance, the CPU 16 reads out performance information data of 4/4 time as shown in FIG. 9(A) and memorizes the performance information data of 4/4 time in the performance memory 22. Subsequently, the CPU 16 subdivides at step 32 the memorized performance information data into each section of two times and sets at step 34 the registers R1–R4 as "0" and the register n as "1", respectively.

Figure 4:
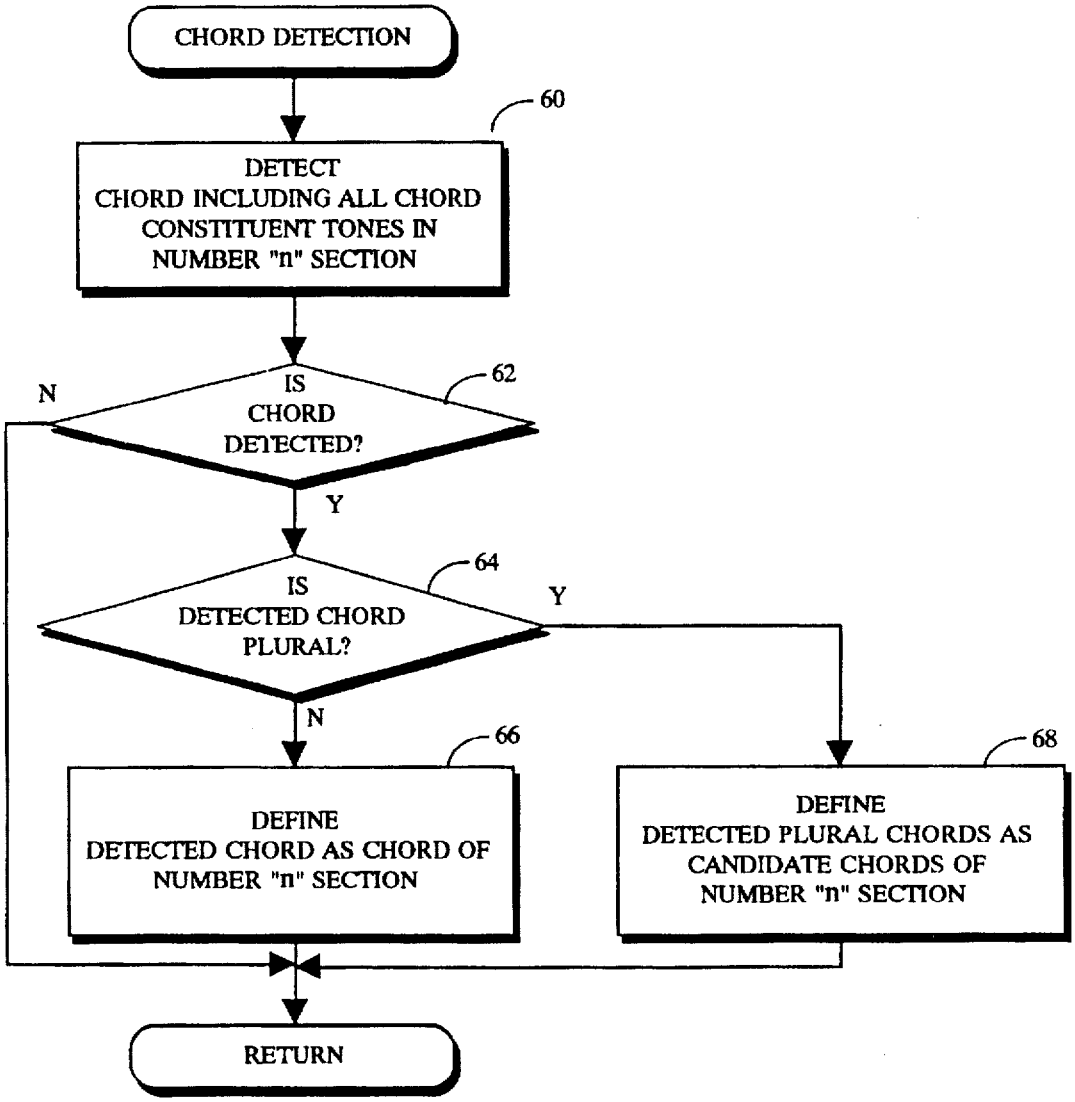
FIG. 4 is a flow chart of a program for chord detection.

When the program proceeds to step 36, the CPU 16 executes a program for chord detection shown in FIG. 4. At step 60 of FIG. 4, the CPU 16 detects a chord including all the chord constituent tones in the section of the number "n" (the number of the register "n"). In this instance, the CPU 16 compares the tone name information data of all the notes in the number "n" section with the tone name information data of each chord in the chord table to read out the chord name information data identical with the tone name information data from the chord table and memorizes the chord name information in the register R1. At the following step 62, the CPU 16 determines whether or not a chord has been detected on a basis of the contents of the register R1. If the answer at step 62 is "Yes", the CPU 16 determines at step 64 whether the detected chord is plural or not. If the answer at step 64 is "No", the CPU 16 causes the program to proceed to step 66. At step 66, the CPU 16 defines the detected chord as a chord of the number "n" section and memorizes the chord name information corresponding with the defined chord in a memory region of the register R4 corresponding with the number "n" section. Thereafter, the CPU 16 returns the program to the main routine shown in FIG. 3. If the answer at step 64 is "Yes", the CPU 16 defines the detected plural chords as candidate chords of the number "n" section and memorizes a chord name information data corresponding with the candidate chord in a memory region of the register R3 corresponding with the number "n" section. Thereafter, the CPU 16 returns the program to the main routine shown in FIG. 3. If the answer at step 62 is "No", the CPU 16 returns the program to the main routine shown in FIG. 3.

Figure 5:
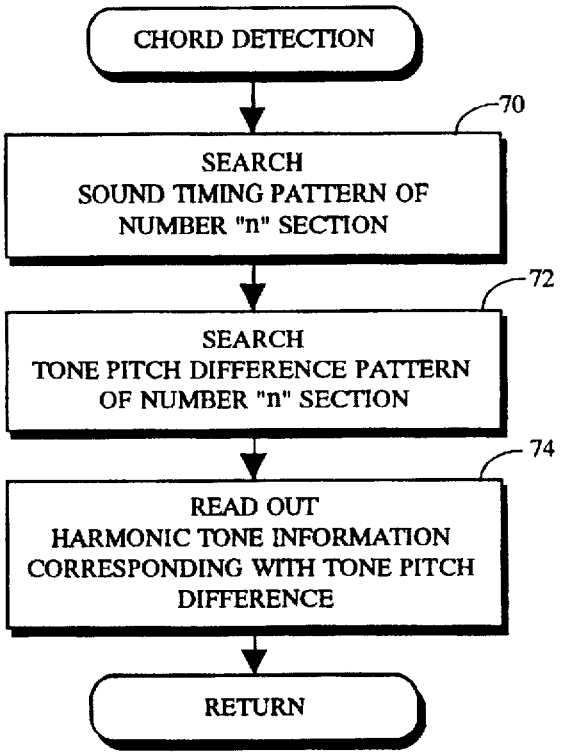
FIG. 5 is a flow chart of a program for detection of harmonic tones.

When the program returns to step 38 of the main routine, the CPU 16 executes a program for detection of harmonic tones shown in FIG. 5. At step 70 of FIG. 5, the CPU 16 searches a sound timing pattern of the number "n" section. If in this instance, there is only a single rest or a single note in the number "n" section, an information data indicative of the sort of the rest or note is produced as the sound timing pattern. If a rest and a note are mixed or there are a plurality of notes in the number "n" section, an information data indicative of an arrangement condition of the rest and notes is produced as the sound timing pattern. Thus, the CPU 16 compares the produced sound timing pattern with the sound timing patterns T1, T2, T3, . . . $T_m$, $T_{m+1}$ in the harmonic tone table in sequence and detects the sound timing pattern coincident with the produced sound timing pattern.

When the program proceeds to step 72 of FIG. 5, the CPU 16 searches the tone pitch difference pattern of the number "n" section. If in this instance, there is only a single rest or note in the number "n" section, the CPU 16 detects a mark information data (for example, P1 or P2) corresponding with the sound timing pattern searched at step 70. If a rest and a note are mixed or there are a plurality of notes in the number "n" section, an information data indicative of each difference in tone pitch between adjacent tones is produced as a tone pitch difference pattern. Thus, the CPU 16 compares the produced tone pitch difference pattern with the tone pitch difference patterns P1, P2, P3, . . . $P_m$, $P_{m+1}$ in the harmonic tone table in sequence and detects the tone pitch difference pattern coincident with the produced tone pitch difference pattern. Thereafter, the CPU 16 reads out at step 74 a harmonic tone information data corresponding with the tone pitch difference pattern detected at step 72 from the harmonic table of memory 24 and memorizes the harmonic tone information data in the register R2. In turn, the program returns to the main routine shown in FIG. 3.

Assuming that when the sound timing patterns T3, T4 were searched by processing at step 70, the tone pitch differences $D_1$, $D_2$ each have been represented by +1 while the tone pitch difference $D_3$ has been represented by +3, the tone pitch difference pattern P4 is searched by processing at step 72. Thus, the harmonic tone information data indicative of the names of the first, third and fourth tones corresponding with the tone pitch difference pattern P4 is read out by processing at step 74 and memorized in the register R2.

When the program proceeds to step 40 of FIG. 3, the CPU 16 determines whether a harmonic tone has been detected on a basis of the contents of the register R2 or not. If the answer at step 40 is "Yes", the CPU 16 detects at step 42 a chord including all the harmonic tones in the number "n" section as chord constituent tones. In this instance, the CPU 16 compares a tone name information data represented by the harmonic tone information data in the register R2 with each tone name information data of the chord names in the chord table and memorizes the chord name information coincident with the tone name information data in the register R1.

At the following step 44, the CPU 16 determines on a basis of the contents of the register R1 whether the sum of chords detected by processing at step 36 and 42 is plural or not. If the answer at step 44 is "No", the CPU 16 defines at step 46 the detected chord as a chord of the number "n" section and memorizes a chord name information data corresponding with the defined chord in a memory region of the register R4 corresponding with the number "n" section. In this instance, the chord name information data memorized in the register R4 corresponds with the chord detected by processing at step 36 or step 42, and the chord name information data corresponding with the chord detected by processing at step 36 is rewritten. If the answer at step 44 is "Yes", the CPU 16 defines the plural chords detected by processing at step 36 and/or 42 as candidate chords of the number "n" section and memorizes the a chord name information data corresponding with the candidate chords in a memory region of the register R3 corresponding with the number "n" section. As a result, a plurality of chord names are memorized in the register R3.

When determines a "No" answer at step 40 or finished processing at step 46 or 48, the CPU 16 causes the program to proceed to step 50. At step 50, the CPU 16 determines whether processing of a final section of the performance information data has finished or not. If the answer at step 50 is "No", the CPU 16 increases at step 52 the value of "n" by addition of "1" and returns the program to step 36. Subsequently, the CPU 16 repeats execution of the program in the same manner as described above. When finished processing of the final section during execution of processing at step 36–52, the CPU 16 determines a "Yes" answer at step 50 and causes the program to proceed to step 54. At step 54, the CPU 16 executes a program for chord determination as will described later with reference to FIG. 8.

In FIG. 6 there is illustrated a modification of the harmonic tone table stored in the table memory 24, wherein a plurality of sound patterns S1, S2, S3, S4, . . . are substituted for the sound timing patterns and tone pitch difference patterns in the harmonic tone table shown in FIG. 2. The harmonic tone table of FIG. 6 is designed to memorize the sound patterns S1, S2, S3, S4, . . . for each performance section of two times and harmonic tones corresponding with the sound patterns. The sound pattern S1 is in the form of an information data of a half rest, and the sound pattern S2 is in the form of an information data of a half note. The sound patterns S3 and S4 each are in the form of an information data of four eighth notes. In this case, the plural notes of the sound patterns are memorized in the form of an information data of a difference in tone pitch between a head tone and the following tone. For example, the information data of the sound pattern S3 includes a difference $Q_1$ in tone pitch between a head tone (first tone) and a second tone, a difference $Q_2$ in tone pitch between the first tone and a third tone and a difference $Q_3$ in tone pitch between the first tone and a fourth tone which are respectively represented as "0". In the information data of the sound pattern S4, the differences $Q_1$, $Q_2$, $Q_3$ in tone pitch are respectively represented as semitones 2, 4 and 5. For example, the tone pitch relationship of $Q_1$=2, $Q_2$=4, $Q_3$=5 is defined in an arrangement of tone names C, D, E, F.

In the harmonic tone table, a harmonic tone information data corresponding with the sound pattern S1 is represented as a null. A harmonic tone information data corresponding with the sound pattern S2 represents the name of the first tone corresponding with the half note in the sound pattern S2. A harmonic tone information data corresponding with the sound pattern S3 represents the names of the first to fourth tones in the sound pattern S3. A harmonic tone information data corresponding with the sound pattern S4 represents the names of the first and third tones in the sound pattern S4.

Figure 7:
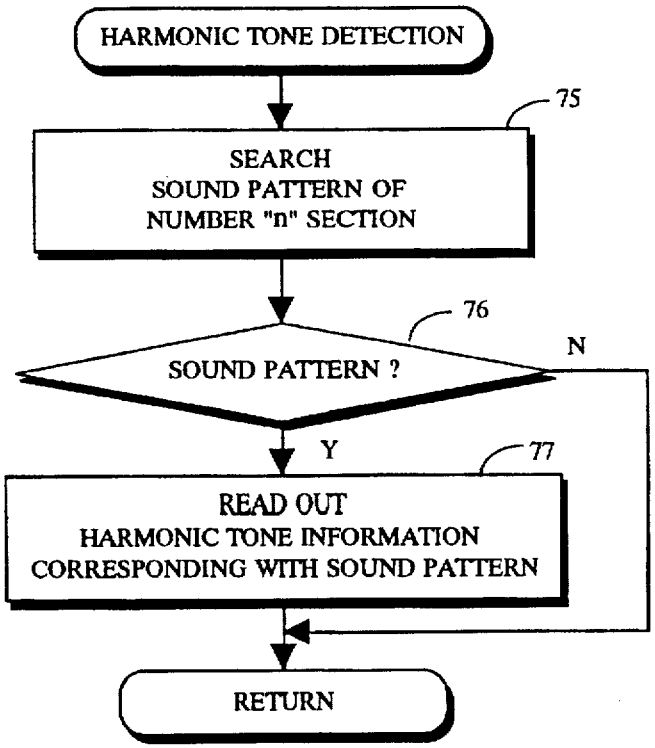
FIG. 7 is a flow chart of a modification of the program for detection of harmonic tones.

In FIG. 7 there is Illustrated a modification of the program for detection of a harmonic tone to be executed by using the harmonic tone table of FIG. 6. At step 75 of the modified program, the CPU 16 searches a sound pattern of the number "n" section. If in this instance, there is only a single rest or a single note in the number "n" section, an information data indicative of the kind of the rest or note is produced as the sound pattern. If a rest and a note are mixed or there are a plurality of notes in the number "n" section, an information data indicative of an arrangement of the rest and note or a difference in tone pitch between a head tone and the following tone is produced as the sound pattern. Thus, the CPU 16 compares the produced sound pattern with the sound patterns S1, S2, S3, S4, . . . in the harmonic tone table of memory 24 and detects the sound pattern coincident with the produced sound pattern. Thereafter, the CPU 16 determines at step 76 whether the sound pattern has been detected or not. If the answer at step 76 is "Yes", the CPU 16 reads out at step 77 the harmonic tone information data corresponding with the detected sound pattern from the harmonic tone table of FIG. 6 and memorizes the harmonic tone information in the register R2. When determined a "No" answer at step 76 or finished processing at step 77, the CPU 16 returns the program to the main routine of FIG. 3.

Figure 8:
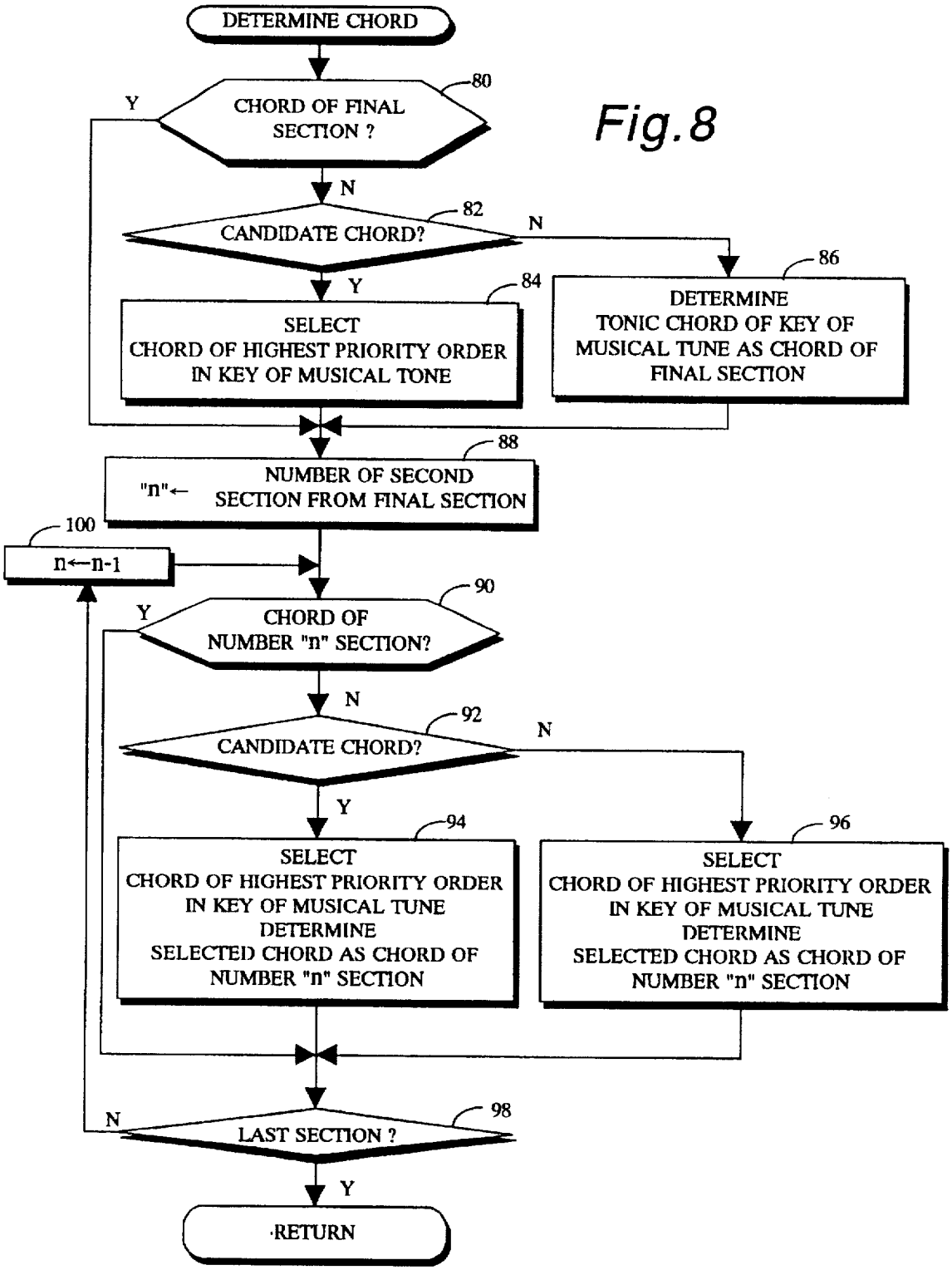
FIG. 8 is a flow chart of a program for chord determination.

Illustrated in FIG. 8 is a program for chord determination. At step 80 of the program, the CPU 16 determines on a basis of the contents of the register R4 whether a chord of the final section has been determined or not. If there is a chord name information data in the memory region of the register R4 corresponding with the final section, the CPU 16 determines a "Yes" answer at step 80. If not, the CPU 16 determines a "No" answer at step 80 and causes the program to proceed to step 82. At step 82, the CPU 16 determines on a basis of the contents of the register R3 whether there is a candidate chord in the final section or not. If the answer at step 82 is "Yes", the CPU 16 selects at step 84 a chord of the highest priority order in the key of the musical tune from the candidate chords memorized in the register R3 and determines the selected chord as the chord of the final section. Thus, the CPU 16 memorizes a chord name information data corresponding with the determined chord in a memory region of the register R4 corresponding with the final section.

If the answer at step 82 is "No", the CPU 16 determines at step 86 the tonic chord of the key of the musical tune as the chord of the final section and memorizes a chord name information data corresponding with the determined chord in the memory region of the register R4 corresponding with the final section. When determined a "Yes" answer at step 80 or finished processing at step 84 or 86, the program proceeds to step 88 where the CPU 16 sets the number of the second section from the final section as "n" and causes the program to proceed to step 90. At step 90, the CPU 16 determines on a basis of the contents of the register R4 whether a chord of the number "n" section has been determined or not. The chord determination is carried out in the same manner as in processing at step 80. If the answer at step 90 is "No", the CPU 16 determines at step 92 on a basis of the contents of the register R3 whether or not there is a candidate chord in the number "n" section.

If the answer at step 92 is "Yes", the CPU 16 selects at step 94 a chord of the highest priority order in the key of the musical tune from the determination chord and candidate chord of the immediately after section and determines the selected chord as the chord of the number "n" section. In this instance, the determination chord of the immediately after section can be detected with reference to the chord name information data memorized in the memory region of the register R4 corresponding with the number "(n+1)" section, and the candidate chord can be detected with reference to the plural chord name information data memorized in the memory region of the register R3 corresponding with the number "n" section. After determined the chord of the number "n" section, the CPU 16 memorizes a chord name information data corresponding with the determination chord in the memory region of the register R4 corresponding with the number "n" section. If the answer at step 92 is "No", the CPU 16 selects at step 96 a chord of the highest priority order in the key of the musical tune from the determination chord of the immediately after section and the candidate chords of the immediately before section and determines the selected chord as the chord of the number "n" section. In this instance, the determination chord of the immediately after section can be detected with reference to the chord name information data memorized in the memory region of the register R4 corresponding with the number "(n+1)" section, and the candidate chords can be detected with reference to the plural chord name information data memorized in the memory region of the register R3 corresponding with the number "(n−1)" section. After determined the chord of the number "n" section, the CPU 16 memorizes a chord name information data corresponding with the determination chord in the memory region of the register R4 corresponding with the number "n" section.

When determines a "Yes" answer at step 90 or finished processing at step 94 or 96, the CPU 16 determines at step 98 whether processing of the initial section has finished or not. If the answer at step 98 is "No", the CPU 16 subtracts "1" from the value "n" at step 100 and returns the program to step 90 to repeat processing at step 90–100 in the same manner as described above. When finished processing of the initial section during processing at step 90–100, the CPU 16 determines a "Yes" answer at step 98 and returns the program to the main routine of FIG. 3.

In the preferred embodiment described above, a harmonic tone is detected on a basis of a sound timing and a tone pitch relationship at each section of two times in an input performance information data, and a chord is determined on a basis of the detected harmonic tone. Thus, with respect to a musical tune starting from a strong beat as shown in FIG. 9(B) or a musical tune starting from a weak beat as shown in FIG. 9(C), harmonic tones are detected as shown by the arrows so that the chords can be automatically determined as shown in FIGS. 9(B) or 9(C). In this case, a series of chord name information data at a chord analysis mode are memorized in the register R4 as shown in FIGS. 9(B) or (C). When the chord analysis mode is changed to an automatic performance mode to effect automatic performance of the melody on a basis of the performance information data stored in memory 24, the chord name information data are read out from the register R4 in response to the performance progression, and the tone generator 26 is controlled by the CPU 16 to effect automatic performance in accordance with the chord progression as shown in FIGS. 9(B) or 9(C).

In actual practices of the present invention, the foregoing embodiments may be modified as follows:

1) Although in the embodiments the performance information data has been divided into each section of two times, the performance information data may be divided into each section of the other number of times. In the case of three times, the performance information data may be divided into two times and one time.

2) The bar line, time and the like may be automatically determined on a basis of the performance information data.

3) The sound timing patterns, tone pitch difference patterns and sound patterns may be memorized in the form of different patterns in accordance with the kind of rhythms.

From the above description, it will be understood that in the present invention a pattern information data corresponding with a sound timing and a tone pitch relationship in a section of a predetermined time is searched to read out harmonic tone information data corresponding with the searched pattern information data for detection of a harmonic tone. With such detection of the harmonic tone, a chord can be determined in accordance with progression of a musical tune.

What is claimed is:

1. A chord analysis apparatus, comprising:

memory means for memorizing a plurality of information data patterns, each indicative of a sound timing and a tone pitch relationship in a performance section of a predetermined number of beats, and for memorizing harmonic tone information data corresponding to each of said information data patterns;

search means for searching said plurality of information data patterns to find a corresponding information data pattern from said plurality of information data patterns that corresponds with a sound timing and a tone pitch relationship in performance information data representative of a section of a musical tune;

means for reading out harmonic tone information data corresponding to the information data pattern found by said search means from said memory means; and means for defining at least one chord of the section of the musical tune based on the harmonic tone information data read out from the memory means.

2. A chord analysis apparatus as claimed in claim 1, wherein each information data pattern comprises a sound timing pattern and a tone pitch difference pattern that corresponds to the sound timing pattern.

3. A chord analysis apparatus as claimed in claim 1, wherein each information data pattern comprises a sound pattern, and wherein at least one sound pattern of at least one information data pattern includes information data of a difference in tone pitch between a head tone and a following tone.

4. A chord analysis apparatus as claimed in claim 1, further comprising means for memorizing a plurality of chord names and tone name information data corresponding to each of the chord names.

5. A chord analysis apparatus as claimed claim 4, wherein the means for detecting matches the harmonic tone information data read out from the memory means to the memorized tone name information data to identify the at least one chord of the section of the musical tune.

6. A chord analysis apparatus, comprising:

memory means for memorizing a plurality of information data patterns, each indicative of a sound timing and a tone pitch relationship in a performance section of a predetermined number of beats, and for memorizing harmonic tone information data corresponding to each of the information data patterns;

means for dividing performance information data of a musical tune into a plurality of sections of the predetermined number of beats;

search means for searching said plurality of information data patterns to find a corresponding information data pattern from said plurality of information data patterns that corresponds with a sound timing and a tone pitch relationship in each divided section;

read-out means for reading out harmonic tone information data corresponding to the information data pattern found by said search means for each divided section from said memory means; and chord determination means for determining each chord of the divided sections based on the harmonic tone information data read out by said read-out means.

7. A chord analysis apparatus as claimed in claim 6, wherein each information data pattern comprises a sound timing pattern and a tone pitch difference pattern that corresponds to the sound timing pattern.

8. A chord analysis apparatus as claimed in claim 6, wherein each information data pattern comprises a sound pattern, and wherein at least one sound pattern of at least one information data pattern includes information data of a difference in tone pitch between a head tone and a following tone.

9. A chord analysis apparatus as claimed in claim 6, further comprising means for memorizing a plurality of chord names and tone name information data corresponding to each of the chord names.

10. A chord analysis apparatus as claimed claim 9, further comprising chord detection means for matching the harmonic tone information data read out by the read-out means from the memory means to the memorized tone name information data to define at least one detected chord for each divided section of the musical tune.

11. A chord analysis apparatus as claimed in claim 10, wherein the chord detection means further comprises chord definition means for defining for each of the divided sections at least one of a chord and a plurality of candidate chords based on the at least one detected chord.

12. A chord analysis apparatus as claimed in claim 10, wherein the chord determination means, for a divided section that is the final section of the musical tone and for which the chord defining means has defined a plurality of candidate chords, selects the candidate cord of highest priority order in a key of the musical tune from the plurality of candidate chords as a chord of the final section.

13. A method of determining a chord in accordance with progression of a musical tone, comprising the steps of:

memorizing a plurality of information data patterns, each indicative of a sound timing and a tone pitch relationship in a performance section of a predetermined number of beats;

memorizing harmonic tone information data corresponding to each of the information data patterns;

dividing performance information data of a musical tune into a plurality of sections of the predetermined number of beats;

searching said plurality of information data patterns to find a corresponding information data pattern from said plurality of information data patterns that corresponds with a sound timing and a tone pitch relationship in each divided section;

reading out harmonic tone information data corresponding to information data pattern found by said search means for each divided section from said memory means; and determining each chord of the divided sections based on the harmonic tone information data.

14. A method as claimed in claim 13, wherein each information data pattern comprises a sound timing pattern and a tone pitch difference pattern that corresponds to the sound timing pattern.

15. A method as claimed in claim 13, wherein each information data pattern comprises a sound pattern, and wherein at least one sound pattern of at least one information data pattern includes information data of a difference in tone pitch between a head tone and a following tone.

16. A method as claimed in claim 13, further comprising memorizing a plurality of chord names and tone name information data corresponding to each of the chord names.

17. A method as claimed in claim 16, further comprising matching the harmonic tone information data read out the memorized tone name information data to define at least one detected chord for each divided section of the musical tune.

18. A method as claimed in claim 17, further comprising defining for each of the divided sections at least one of a chord and a plurality of candidate chords based on the at least one detected chord.

19. A method as claimed in claim 18, further comprising, for a divided section that is the final section of the musical tone and for which a plurality of candidate chords has been defined, selecting the candidate cord of highest priority order in a key of the musical tune from the plurality of candidate chords as a chord of the final section.

20. A machine readable media programmed to execute the steps of:

memorizing a plurality of information data patterns, each indicative of a sound timing and a tone pitch relationship in a performance section of a predetermined number of beats;

memorizing harmonic tone information data corresponding to each of the information data patterns;

dividing performance information data of a musical tune into a plurality of sections of the predetermined number of beats;

searching said plurality of information data patterns to find a corresponding information data pattern from said plurality of information data patterns that corresponds with a sound timing and a tone pitch relationship in each divided section;

reading out harmonic tone information data corresponding to information data pattern found by said search means for each divided section from said memory means; and determining each chord of the divided sections based on the harmonic tone information data.

* * * * *